US008656559B2

(12) United States Patent
Hung

(10) Patent No.: US 8,656,559 B2
(45) Date of Patent: Feb. 25, 2014

(54) HINGE STRUCTURE

(75) Inventor: I-Tsung Hung, Changhua County (TW)

(73) Assignee: Hong Jeu Industrial Co., Ltd., Changhua County (TW)

( * ) Notice: Subject to any disclaimer, the term of this patent is extended or adjusted under 35 U.S.C. 154(b) by 28 days.

(21) Appl. No.: 13/545,966

(22) Filed: Jul. 10, 2012

(65) Prior Publication Data

US 2013/0152339 A1 Jun. 20, 2013

(30) Foreign Application Priority Data

Dec. 16, 2011 (TW) ..... 100223854 U

(51) Int. Cl.
*E05D 15/00* (2006.01)

(52) U.S. Cl.
USPC ..... 16/369; 16/286

(58) Field of Classification Search
USPC ..... 16/369, 286
See application file for complete search history.

(56) References Cited

U.S. PATENT DOCUMENTS

| | | | | |
|---|---|---|---|---|
| 5,058,238 | A * | 10/1991 | Lautenschlager | 16/278 |
| 7,861,376 | B2 * | 1/2011 | Fitz et al. | 16/286 |
| 7,987,558 | B2 * | 8/2011 | Beckmann et al. | 16/366 |
| 8,205,298 | B2 * | 6/2012 | Lin et al. | 16/287 |
| 8,225,459 | B2 * | 7/2012 | Waltemate et al. | 16/366 |
| 2007/0006420 | A1 * | 1/2007 | Zetti | 16/287 |
| 2008/0109987 | A1 * | 5/2008 | Chen et al. | 16/68 |
| 2012/0174338 | A1 * | 7/2012 | Wu et al. | 16/297 |

* cited by examiner

*Primary Examiner* — Victor Batson
*Assistant Examiner* — Matthew Sullivan
(74) *Attorney, Agent, or Firm* — CKC & Partners Co., Ltd.

(57) ABSTRACT

An improved hinge structure is disclosed. The improved hinge structure comprises two fixed bases, a linkage structure, a pushing member, and a buffering damper. The buffering damper is located on the fixed base, wherein the buffering damper has a friction-resistant soft structure acting as a prop for the support of one end of the linkage structure, whereby the collapse caused by the force generated from the pushing member between furniture or components of the hinge can be avoided, therefore noises and damages caused by the collapse can be indirectly overcame while in use.

7 Claims, 10 Drawing Sheets

HINGE STRUCTURE

RELATED APPLICATIONS

The application claims priority to Taiwan Application Serial Number 100223854, filed Dec. 16, 2011, which is herein incorporated by reference.

BACKGROUND

1. Field of Invention

The present invention relates to a hinge. More particularly, the present invention relates to an improved hinge structure of a furniture apparatus.

2. Description of Related Art

Nowadays, hinges are commonly used on furniture doors and cabinets. Taking a furniture door as an example, the hinge is usually mounted between a door leaf and a door frame to provide a support and guidance while opening or closing a door. Over the past days, the conventional hinge usually uses variable types of pivot devices, supporters, and pressure reservoirs or springs, to provide a rotational force for displacing the hinge. Nevertheless, the conventional designs of hinges mentioned above do not contain a function for buffering, a collapse would be caused by closing a door rudely and causes lots of loudly noises, the door leaf and the door frame could therefore be further damaged easily.

To overcome the defects aforementioned, recently, hinges containing buffer functions, namely the buffer hinge, have been brought out, in which the door leaf can be closed slowly to avoid collapses and noises. The buffer hinges have, generally, two fixed bases which are arranged on furniture in a corresponding position with a linkage structure and a returning spring locating between the two fixed bases, thus to provide a rotational displacement. In addition, a pressure reservoir is applied to the buffer hinge mentioned above to provide a buffer function. The pressure reservoir is pivotally connected to the linkage structure, and thus the pressure reservoir buffers the hinge while in use.

Still, components between linkage structures and pressure reservoirs of the recent buffer hinges are trivial and difficult to be assembled, therefore the cost and assembling duration largely increase.

Besides, springs are used in some of the pressure reservoirs and are located inside it, however, the spring and the components located inside the reservoir will deform and causes an elastic fatigue with a passage of time. What is more, pressure reservoirs of oil or hydraulic fluid may cause leakages and high-cost. Therefore, the buffering efficiency of the buffer hinges described above will decrease or will even be broken down after a period of time. In addition, the components between the linkage structure is nonadjustable, and the pressure reservoir are trivial thus it is difficult to be assembled. As a result, once a component is broken, it is quite unavailable to simply substitute the broken component with a new one, but to replace the whole hinge; it is very expensive for users to repair the broken hinge.

SUMMARY

In considering of the aforementioned, an improved hinge structure is provided in the present invention, in which the improved hinge structure effectively avoids the collapse caused by the force of the pushing member between furniture or hinge components.

According to one embodiment of the present disclosure, an improved hinge structure comprises a first fixed base, a linkage structure, a pushing member, a second fixed base, and a buffering damper, wherein the linkage structure comprises a plurality of links. One end of the linkage structure is pivotally connected to the first fixed base, and the other end of the linkage structure has a resisting portion. The pushing member is connected to the linkage structure to provide a returning force. The second fixed base is pivotally connected to the other end of the linkage structure, wherein a positioning space is located in the second fixed base. An opening is located at the positioning space, wherein the opening corresponds to the resisting portion of the linkage structure. The buffering damper mentioned above is located in the positioning space, and the buffering damper has a friction-resistant soft surface providing a buffer during a friction process of the resisting portion.

The buffering damper which locates on a fixed base is used in the present invention, in which the buffering damper has a friction-resistant soft surface acting as a prop for the support of one end of the linkage structure, whereby the collapse caused by the force generated from the pushing member between furniture or components of the hinge can be avoided, therefore noises and damages caused by the collapse can be indirectly overcame while in use.

Besides, in addition to the aforementioned, wherein the friction-resistant soft surface of the buffering damper can be arc shaped, circular, polygonal, or a combination thereof.

According to another embodiment of the present invention, wherein the improved hinge structure comprises: a first fixed base, a linkage structure, a pushing member, a second fixed base, a positioning base, a buffering damper, and a adjusting screw. The linkage structure comprises a plurality of links, and one end of the linkage structure is pivotally connected to the first fixed base, and the other end of the linkage structure has a resisting portion. The pushing member is connected to the linkage structure to provide a returning force. The second fixed base is pivotally connected to the other end of the linkage structure, and a positioning base is located on the second fixed base, wherein a positioning space is located in the second fixed base. An opening is located at said positioning space, wherein the opening corresponds to the resisting portion of the linkage structure, and has an adjusting screw hole passing through the closed end of the positioning base. The buffering damper is located in the positioning space, and the buffering damper has a friction-resistant soft surface exposing outside of the opening to resist the friction of the resisting portion of the linkage structure during a friction process. The adjusting screw mentioned above is located and screwed into an adjusting screw hole of the positioning base, wherein the adjusting screw can be displaced back and forth toward the opening, whereby the buffering damper can be displaced toward the outside or the inside of the opening. Therefore, the buffering efficiency of the buffering damper in the present embodiment can be adjustable.

It is worth to be mentioned that, a metal blocking plate can be set between the adjusting screw and the buffering damper, whereby damages of the buffering damper having a softer material caused by the adjusting screw having a harder material can be avoided while the adjusting screw pushes against the buffering damper.

Furthermore, the positioning space can be formed from a one-piece positioning base. Besides one-piece type, the positioning base can also be fixed to the fixed base by two rods.

One of the advantages of the present invention is that the buffering damper and the positioning base, which the buffering damper is located in, can be formed as a separable module, and therefore it is easy and simple to be installed in or removed from variable types of hinges. The positioning base can be fabricated through a simple press forming processes. Taking a view of a manufacture, all of the above implies that the buffering damper is able to be installed into the hinge at a second production line only if the buffering damper is needed, whereas a first production line produces standard or conventional hinges without the buffering dampers.

Finally, another advantage of the present invention is that the buffering damper is installed on the fixed base, on the other hand, it is being installed inside of the hinge. Taking a door as an example, it will not be seen while opening the door which provides a better look.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
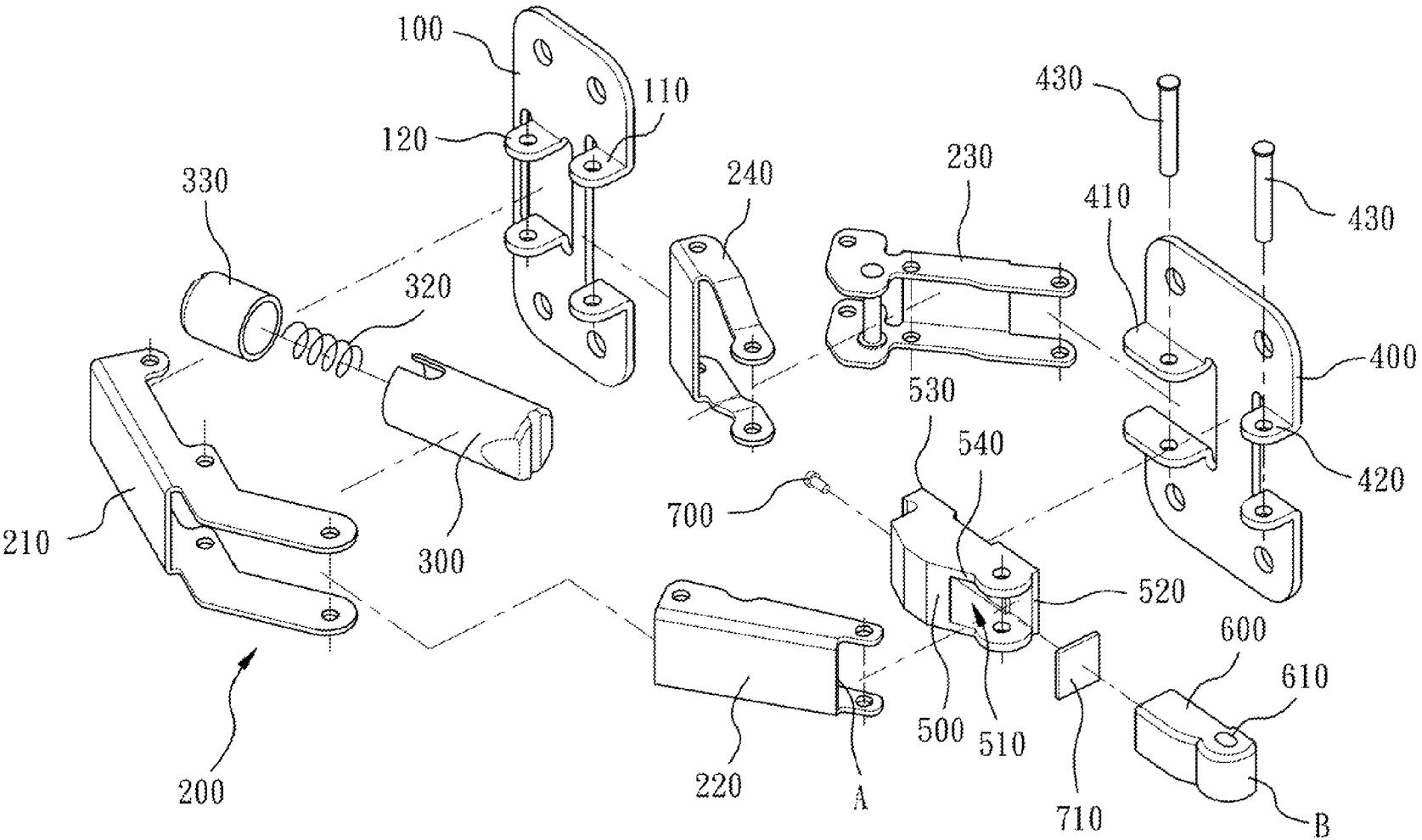
FIG. 1 is a breakdown diagram of one embodiment of the present invention.
Figure 2:
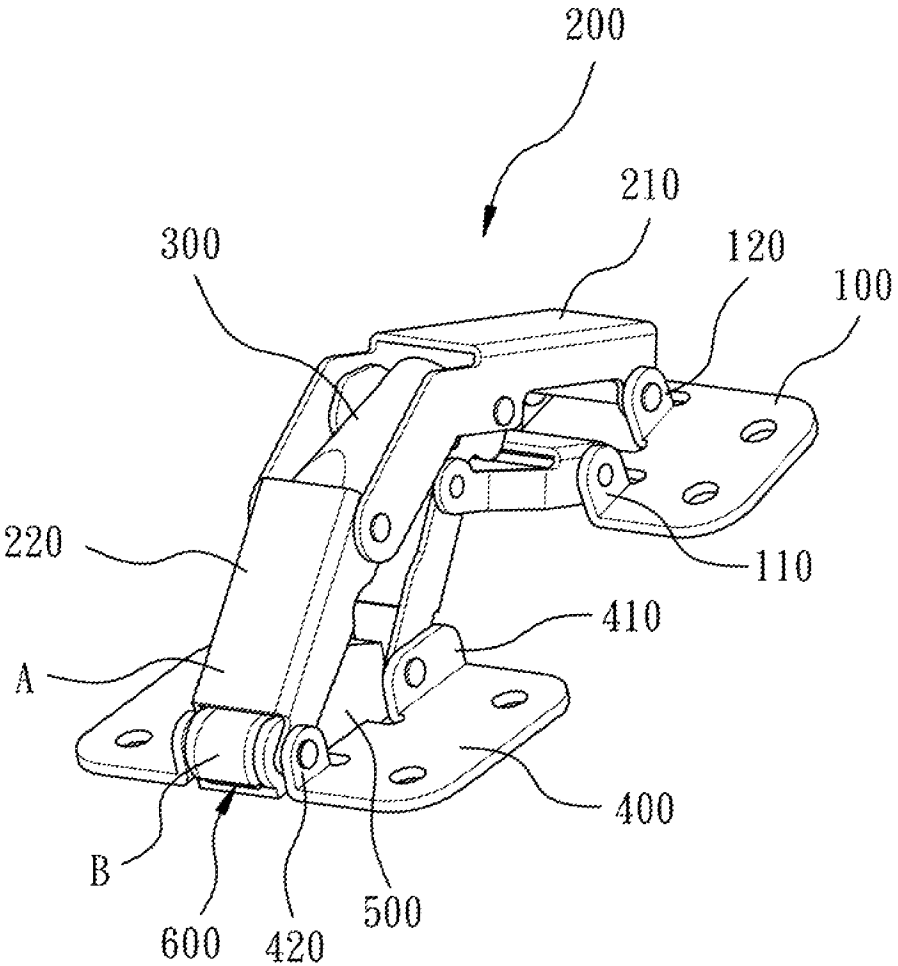
FIG. 2 is an assembly diagram of one embodiment of the present invention.
Figure 3:
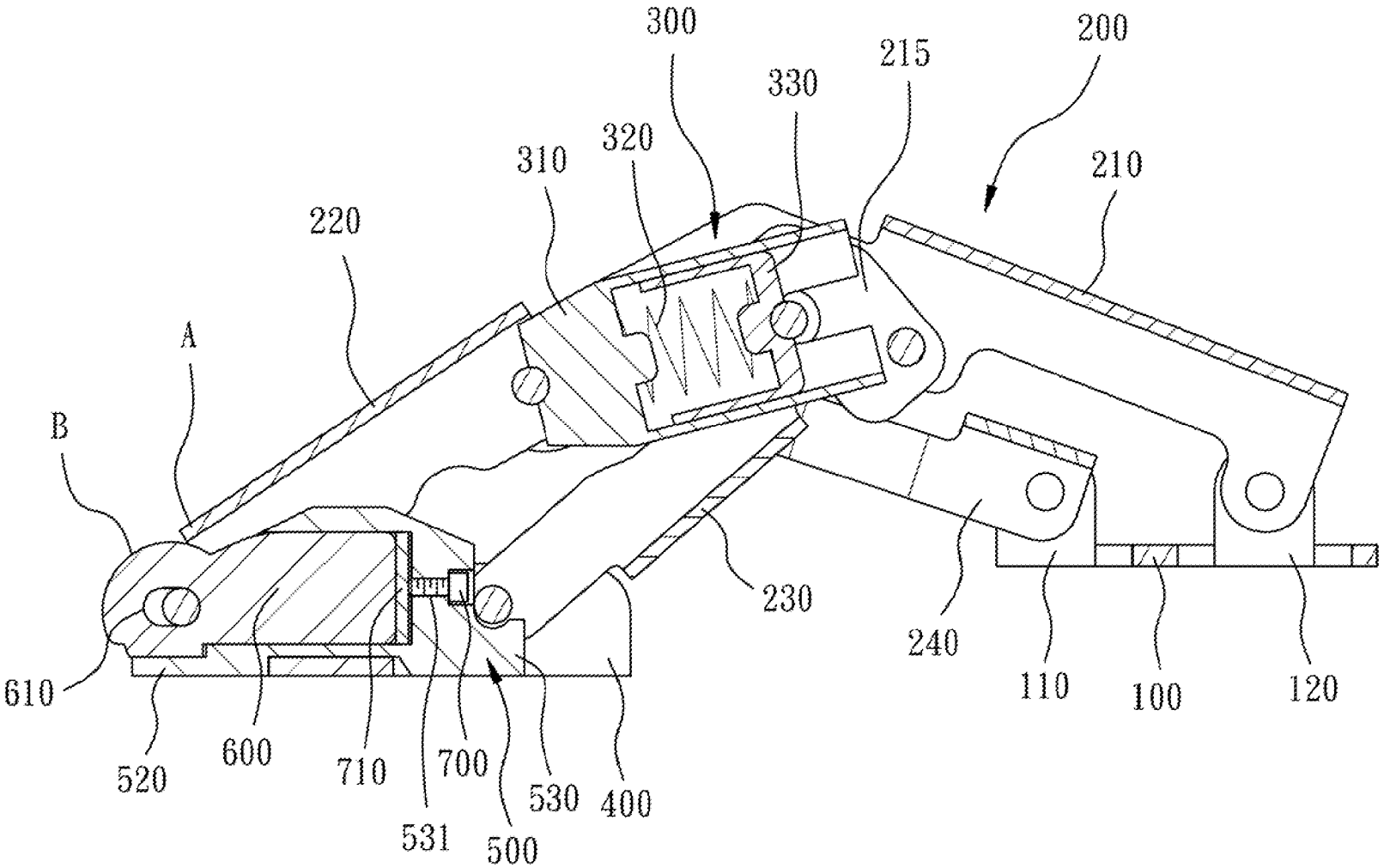
FIG. 3 is an assembly diagram of one embodiment of the present invention of the hinge in an open position.

Please refer to FIG. 1, FIG. 2, and FIG. 3. FIG. 1 and FIG. 2 illustrate a breakdown and assembly diagram of one embodiment of the present invention, respectively. FIG. 3 is an assembly diagram of one embodiment of the present invention of the hinge in an open position.

The improved hinge structure of one example comprising: a first fixed base 100, a linkage structure 200, a pushing member 300, a second fixed base 400, a positioning base 500, a buffering damper 600, and an adjusting screw 700.

The first fixed base 100 is flat; a first knuckle 110 and a second knuckle are located on the bumps of the first fixed base 100.

The second fixed base 400 is flat, in which a third knuckle 410 and a fourth knuckle 420 are located on the bumps of the first fixed base 400. The second fixed base 400 is pivotally connected indirectly to the first fixed base 100 through a linkage structure 200.

The linkage structure 200 comprises a first link 210, a second link 220, a supporting link 230, and an auxiliary link 240. One end of the first link 210 is pivotally connected to the second knuckle 120 of the first fixed base 100. One end of the second link 220 is pivotally connected to the fourth knuckle 420 of the second fixed base 400. One end of the supporting link 230 is pivotally connected to the third knuckle 410 of the second fixed base 400, and the other end of the supporting end 230 is pivotally connected to the first link 210. One end of the auxiliary link 240 is connected to the first fixed base 100, and the other end of the auxiliary link 240 is pivotally connected to the middle part of the supporting link 230. A resisting portion A is located at the second link 220 of the linkage structure 200, wherein the resisting portion A approaches the second fixed base 400.

The pushing member 300 consists of a bushing 310, a spring 320, and a plug 330. The bushing 310 and the plug 330 of the pushing member 300 are axially movably located between the second link 220 and the supporting link 230, the distance between the second link 220 and the supporting link 230 is longer whether the hinge is in an open or a closed position, so that the spring 320 will then not be compressed. The distance between the second link 220 and the supporting link 230 is shorter while the hinge is in an acting position, and the spring 320 will then be compressed, so that a returning force will be generated by the pushing member 300, which covers the compressed spring 320, locating between the second link 220 and the supporting link 230.

The positioning base 500 is being fabricated through the press forming processes, and the positioning base 500 is bolted to the third knuckle 410 and the fourth knuckle 420 of the second fixed base 400 by rods 430. The positioning base 500 has a positioning space 510 inside the positioning base 500. An open end 520 and a closed end 530 are located at the both sides of the positioning base 500. The positioning space 510 has an opening 540 corresponding to the resisting portion A of the linkage structure 200, and has an adjusting screw hole 531 passing through the center of the closed end 530 of the positioning base 500.

The buffering damper 600 is a piece made by friction-resistant soft material and is located in the positioning space 510. A channel 610 on the buffering damper 600 can let the buffering damper 600 to be pivotally movable while the buffering damper 600 is pivotally connected to the fourth knuckle 420. There are chamfers locating on the sides of the buffering damper 600, and a friction-resistant soft surface B locating at one side of the buffering damper 600 is exposed toward the outside of the opening 540, therefore a buffer is provided between the friction-resistant soft surface B and the resisting portion A of the linkage structure 200.

The adjusting screw 700 is screwed into the adjusting screw hole 531 of the positioning base 500, and the adjusting screw 700 can be displaced toward the outside or toward the inside of the opening 540. Further, the adjusting screw 700 pushes against the buffering damper 600, so that the friction-resistant soft surface B of the buffering damper 600 can be pushed toward the outside or the inside.

Figure 4:
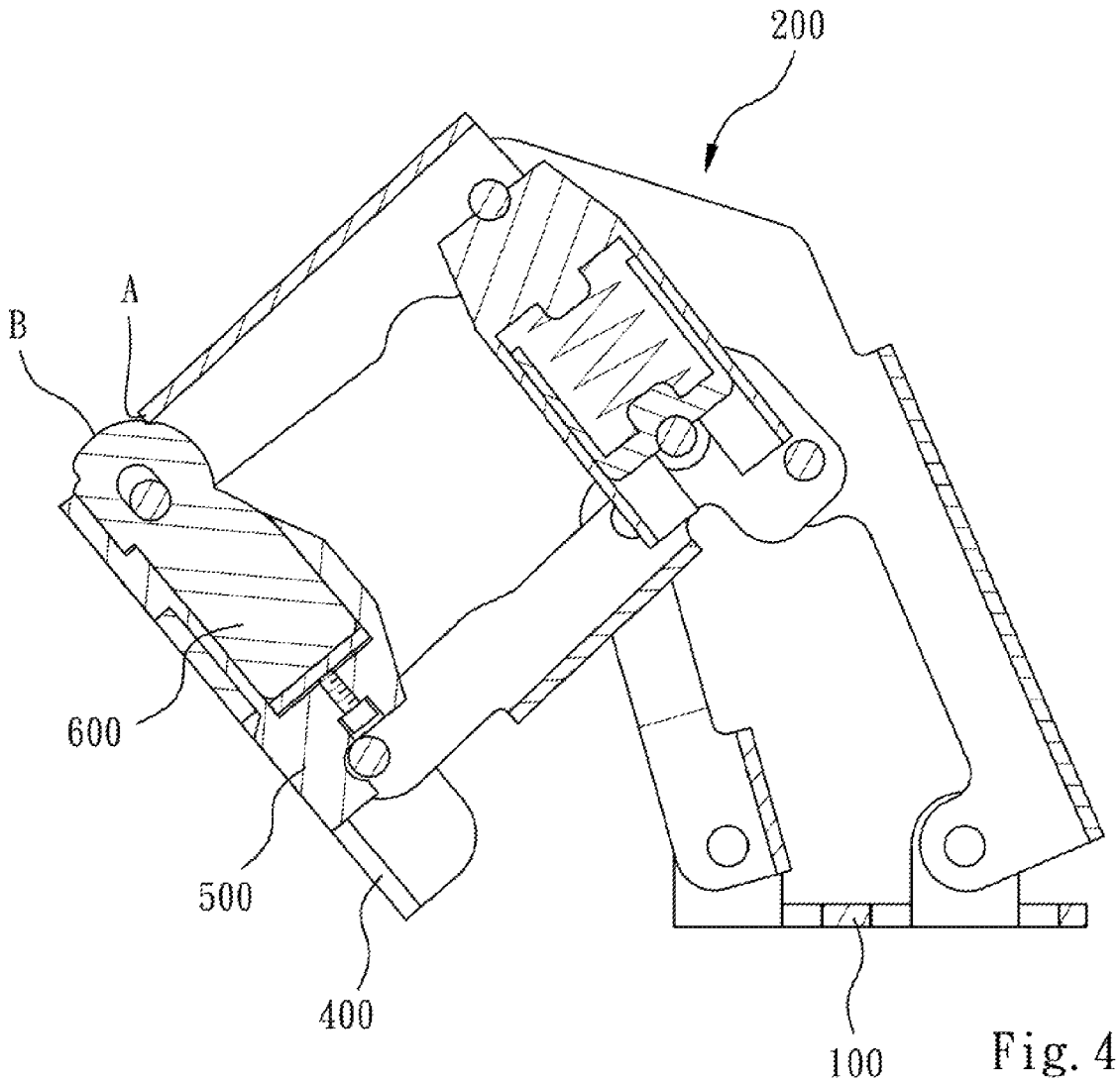
FIG. 4 is an assembly diagram of one embodiment of the present invention of the hinge in an acting position.
Figure 5:
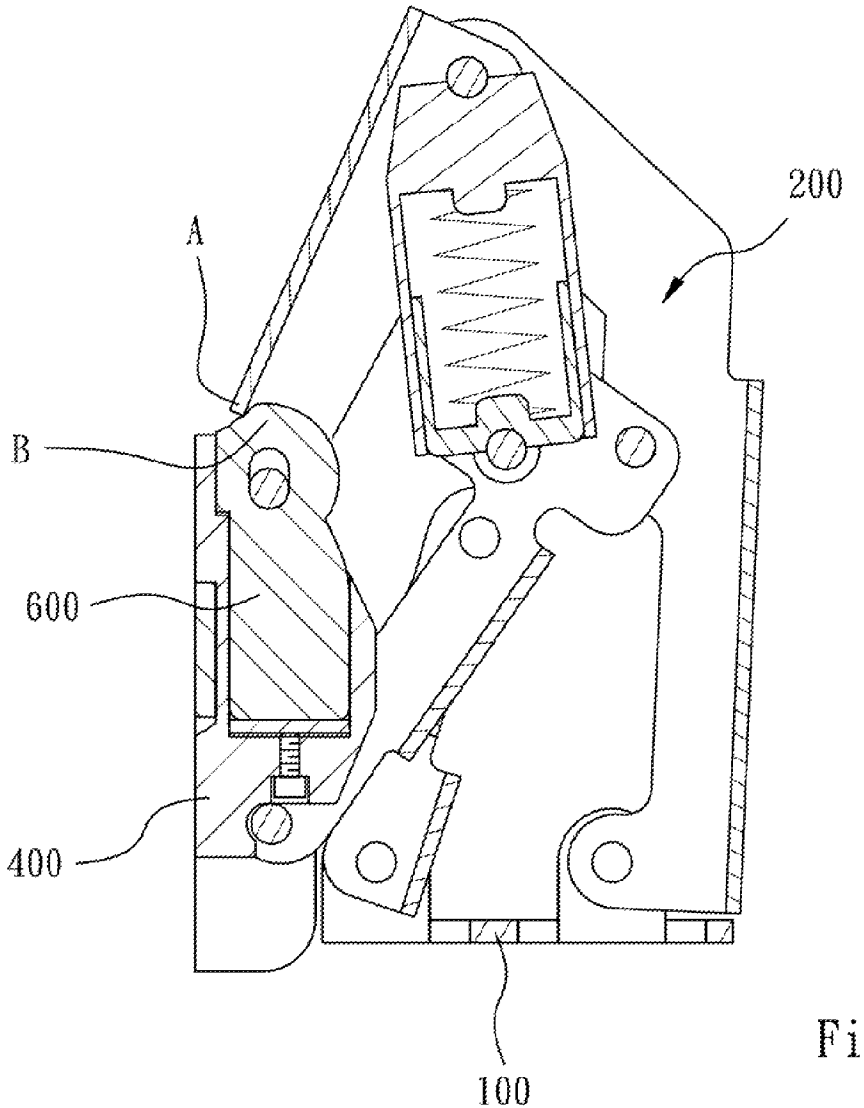
FIG. 5 is an assembly diagram of one embodiment of the present invention of the hinge in a closed position.
Figure 6:
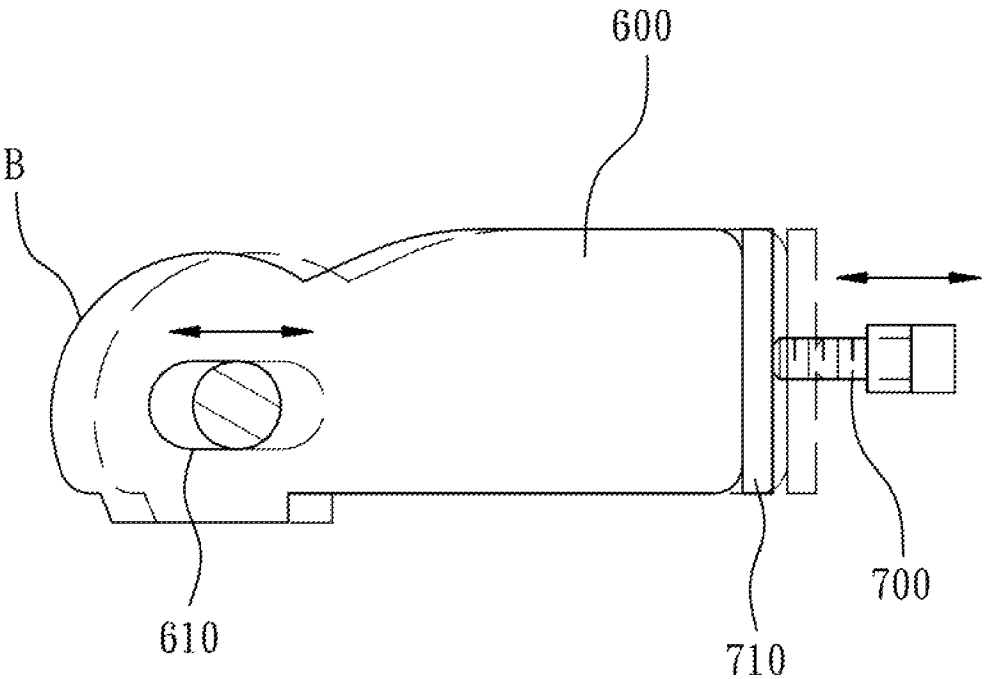
FIG. 6 is a schematic diagram of the buffering damper adjustment of the present invention.
Figure 7:
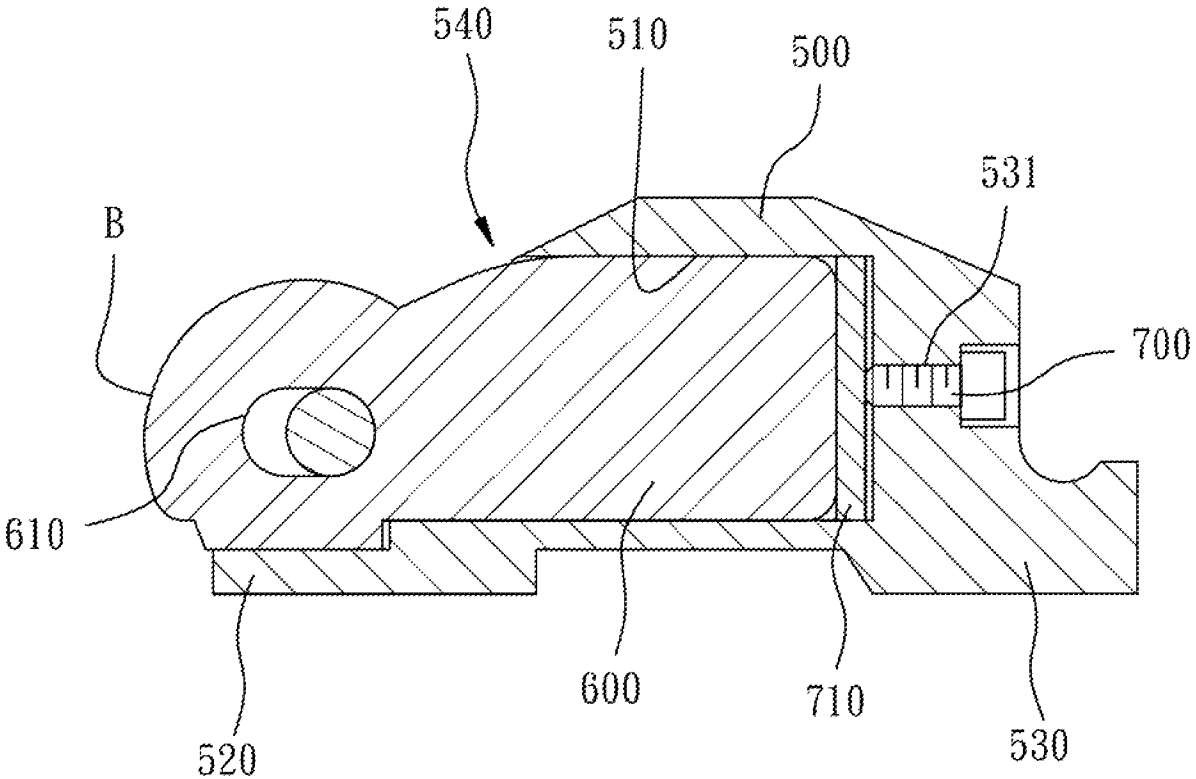
FIG. 7 is a sectional view of the buffering damper combining with the positioning base of the present invention.

Please refer to FIG. 4 and FIG. 5. FIG. 4 and FIG. 5 are the assembly diagrams of one embodiment of the present invention of the hinge in an acting position and a closed position, respectively. Please also refer to FIG. 6 illustrating the adjustment of the buffering damper 600 and FIG. 7 providing a sectional view of the buffering damper combining with the positioning base of the present invention. Because of the design used in the present invention, the friction-resistant soft surface B is corresponded to the resisting portion A of the linkage structure 200, a buffer is provided between the friction-resistant soft surface B and the resisting portion A when the hinge of the present invention is in an open, acting, or closed position. Therefore, the collapses of furniture or between the components of the hinge by the force generated from the pushing member can be effectively avoided, and thus to further avoid the noises and damages. It is worth to be mentioned that, a metal blocking plate 710 can be set between the adjusting screw 700 and the buffering damper 600, whereby the damage of the buffering damper 600, which has a softer material, caused by the adjusting screw 700, which has a harder material, can be avoided while the adjusting screw 700 pushes against the buffering damper 600. Most importantly, users can use the design in the present invention to adjust the exposing level of the buffering damper 600 depending on the requirement of different purposes, such as door leafs with different weights, etc. Moreover, the buffer level between the friction-resistant soft surface B and the resisting portion A is adjustable depending on different purposes while the hinge is in an open, closed, or acting position.

Figure 8:
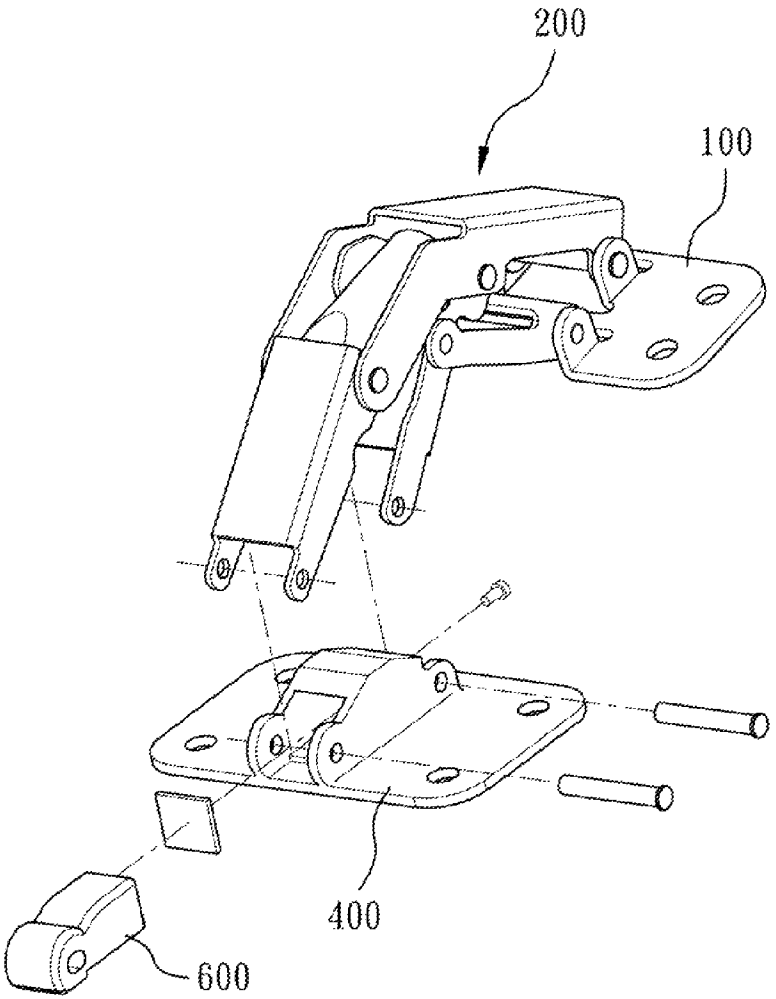
FIG. 8 is a schematic view of a breakdown structure of a one-piece positioning base used in the present invention.

Please refer to FIG. 8. FIG. 8 illustrates a breakdown structure of a one-piece positioning base used in the present invention. It is clear enough to interpret that the positioning base 500 of the present invention can not only be manufactured using separate components, but also can be one-piece manufactured directly with the second fixed base 400 (such as the plastic injection molding). Also, the pivot joint of the linkage structure 200 can still be connected pivotally.

Figure 9:
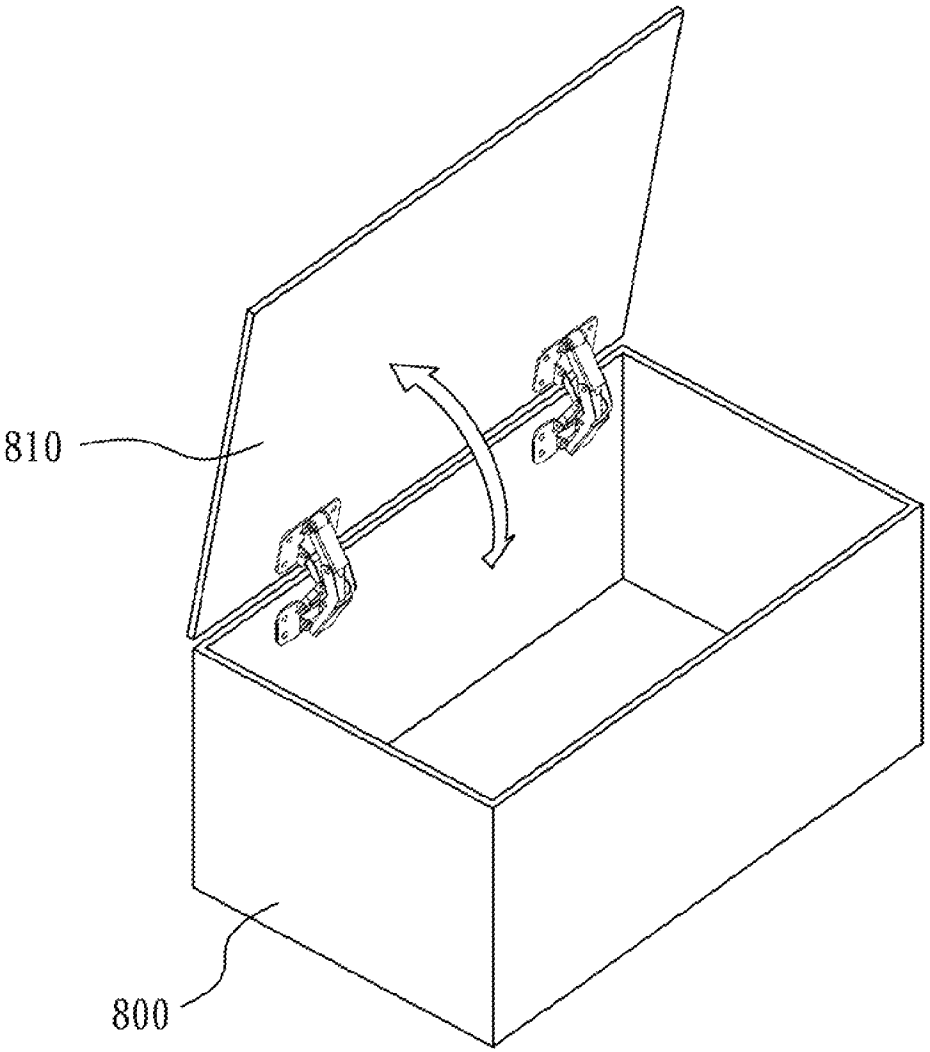
FIG. 9 illustrates a schematic of the present invention being used perpendicularly.
Figure 10:
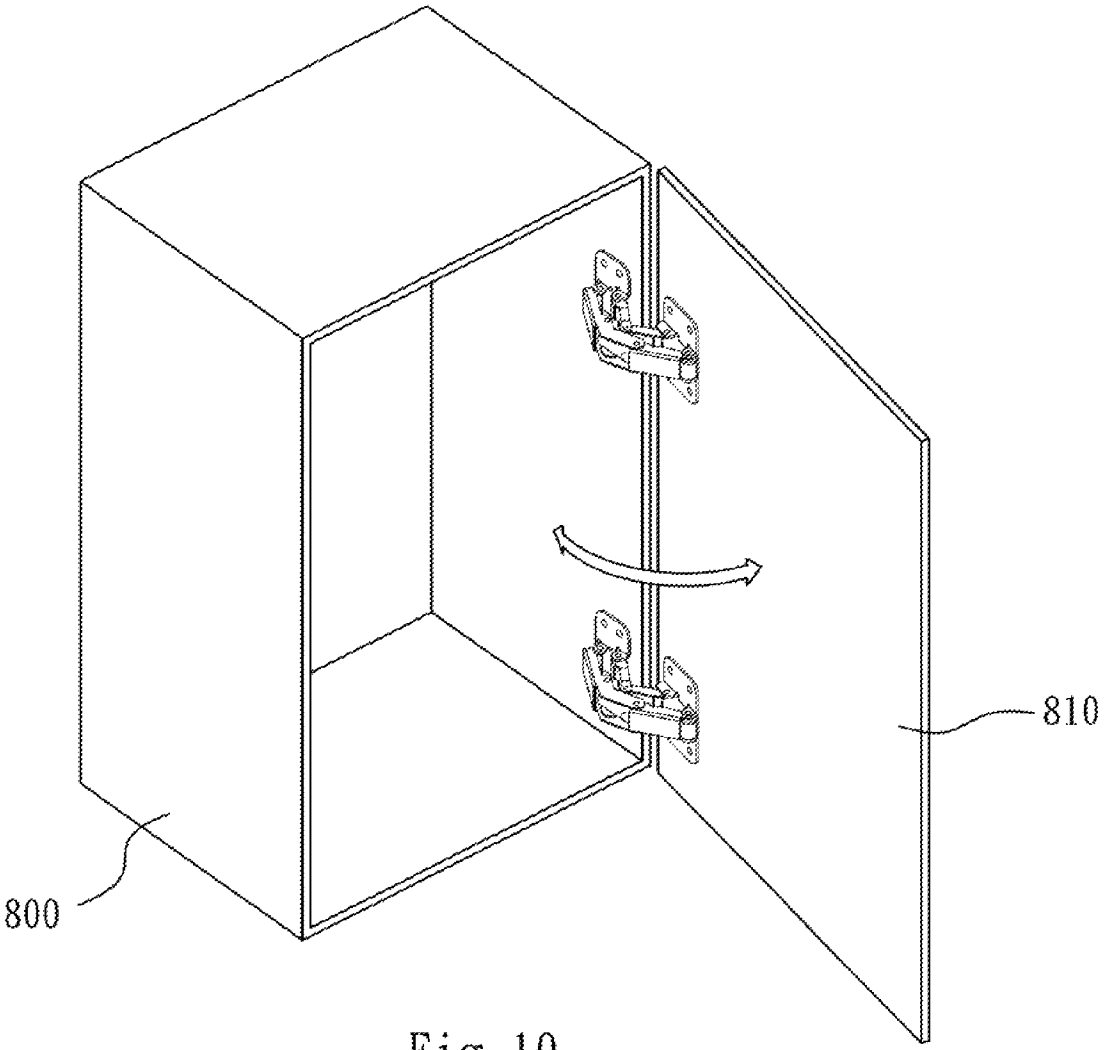
FIG. 10 illustrates a schematic of the present invention being used horizontally.

FIG. 9 illustrates a schematic of the present invention being used perpendicularly, and FIG. 10 illustrates a schematic of the present invention being used horizontally. It is not restricted to the weight or the angle of the door leaf 810 of the furniture 800, so that buffer level can be adjusted depending on different purposes. Therefore, it is to be sure that the present invention is appropriate for variable designs.

In conclusion, the advantages using the present invention are listed below:

First, the collapses of furniture or between the components of the hinge by the force generated from the pushing member can be effectively avoided, and thus to further avoid noises and damages.

Second, the buffering damper and the positioning base, which the buffering damper is located in, can be formed as a separable module therefore it is easy and simple to be installed in or removed from variable types of hinges.

Third, the buffer level between the friction-resistant soft surface B and the resisting portion A is adjustable depending on different purposes while the hinge is in an open, closed, or acting position.

Although the present invention has been described in considerable detail with reference to certain embodiments thereof, other embodiments are possible. Therefore, the spirit and scope of the appended claims should not be limited to the description of the embodiments contained herein.

What is claimed is:

1. An improved hinge structure, comprising:

a first fixed base;

a linkage structure having a plurality of links, wherein one end of the linkage structure is pivotally connected to the first fixed base, and a resisting portion is disposed close to the other end of the linkage structure;

a pushing member connected to the linkage structure for providing a return force;

a second fixed base pivotally connected to the other end of the linkage structure;

a positioning base wherein the positioning base has a positioning space with an opening, wherein the opening is corresponding to the resisting portion of the linkage structure; and a buffering damper arranged in the positioning space, wherein the buffering damper has a friction-resistant soft surface exposed from the opening, thereby providing friction buffer for the resisting portion of the linkage structure; wherein the linkage structure further comprises:

a first link, wherein one end of the first link is pivotally connected to the first fixed base;

a second link, wherein one end of the second link is pivotally connected to the second fixed base, and the other end of the second link is pivotally connected to the first link;

a supporting link, wherein one end of the supporting link is pivotally connected to the second fixed base, and the other end of the supporting link is pivotally connected to the first fixed base;

an auxiliary link, wherein one end of the auxiliary link is pivotally connected to the first fixed base, and the other end of the auxiliary link is pivotally connected to the middle part of the supporting link; and the pushing member located between the second link and the supporting link;

whereby a distance between the second link and the supporting link and being defined by each end of the pushing member is longer while being in an open or closed position, and the distance is shorter while being is in a middle of action, such that the pushing member is pressed to generate a return force while being in a middle of action.

2. The improved hinge structure according to claim 1 further comprising:

a positioning base fixed on the second fixed base to form the positioning space.

3. The improved hinge structure according to claim 1, wherein the positioning base is one-piece connected in a fixed manner to the second fixed base.

4. The improved hinge structure according to claim 1, further comprising:

a plurality of rods;

an open end and a closed end of the positioning base, wherein each of the open end and the closed end is fixed on the second fixed base by the rods.

5. The improved hinge structure according to claim 1, wherein the friction-resistant soft surface of the buffering damper is arc shaped, circular, polygonal, or a combination thereof.

6. An improved hinge structure, comprising:

a first fixed base;

a linkage structure having a plurality of links, wherein one end of the linkage structure is pivotally connected to the first fixed base, and a resisting portion is disposed close to the other end of the linkage structure;

a pushing member connected to the linkage structure for providing a return force;

a second fixed base pivotally connected to the other end of the linkage structure;

a positioning base fixed on the second fixed base to form a positioning space having an open end and a closed end, wherein the positioning space has an opening corresponding to the open end and the resisting portion of the linkage structure, wherein an adjusting screw hole is formed and passes through the closed end of the positioning base;

a buffering damper arranged in the positioning space, wherein the buffering damper has a friction-resistant soft surface exposed from the opening to provide friction buffering for the resisting portion of the linkage structure; and an adjusting screw screwed into the adjusting screw hole of the positioning base, wherein the adjusting screw is operate to move towards the opening to resist against the buffering damper;

wherein the linkage structure further comprises:

a first link, wherein one end of the first link is pivotally connected to the first fixed base;

a second link, wherein one end of the second link is pivotally connected to the second fixed base, and the other end of the second link is pivotally connected to the first link;

a supporting link, wherein one end of the supporting link is pivotally connected to the second fixed base, and the other end of the supporting link is pivotally connected to the first fixed base;

an auxiliary link, wherein one end of the auxiliary link is pivotally connected to the first fixed base, and the other end of the auxiliary link is pivotally connected to a middle portion of the supporting link; and the pushing member located between the second link and the supporting link;

whereby a distance between the second link and the supporting link is longer while being in an open or closed position, and the distance is shorter while being in a middle of an action such that the pushing member is pressed to generate a return force while being in a middle of an action.

7. The improved hinge structure according to claim 6, further comprising:

a blocking plate arranged between the adjusting screw and the buffering damper.

* * * * *